United States Patent [19]

Pusic

[11] Patent Number: 5,065,000

[45] Date of Patent: Nov. 12, 1991

[54] AUTOMATED ELECTRONIC POSTAGE METER HAVING A DIRECT ACESS BAR CODE PRINTER

[76] Inventor: Pavo Pusic, Moluntska 6, 50000 Dubrovnik, Yugoslavia

[21] Appl. No.: 226,777

[22] Filed: Aug. 1, 1988

[51] Int. Cl.[5] ..... G07B 17/02

[52] U.S. Cl. ..... 235/381; 364/464.03

[58] Field of Search ..... 235/381, 375; 364/464.02, 464.01, 464.03

[56] References Cited

U.S. PATENT DOCUMENTS

| | | | |
|---|---|---|---|
| 4,320,461 | 3/1982 | Dlugos | 364/464.02 |
| 4,796,193 | 1/1989 | Pitchenik | 364/464.02 |
| 4,800,506 | 1/1989 | Axelrod et al. | 364/478 |
| 4,802,218 | 1/1989 | Wright et al. | 380/23 |
| 4,805,109 | 2/1989 | Kroll et al. | 364/464.02 |
| 4,809,185 | 2/1989 | Talmadge | 364/464.02 |
| 4,814,995 | 3/1989 | Daniels, Jr. | 364/464.02 |
| 4,835,713 | 5/1989 | Pastor | 364/464.02 |
| 4,837,714 | 6/1989 | Brookner et al. | 364/464.02 |
| 4,868,757 | 9/1989 | Gil | 364/464.02 |
| 4,901,241 | 2/1990 | Schneck | 235/380 |
| 4,907,161 | 3/1990 | Sansone et al. | 364/464.02 |

*Primary Examiner*—David Trafton
*Assistant Examiner*—Richard M. Weinberg
*Attorney, Agent, or Firm*—Marks Murase & White

[57] ABSTRACT

The present invention discloses an automated electronically controlled postage meter including a mail weighting means, an alphanumerical keyboard, a direct access bar code thermal transfer printer, a magnetic and IC card reader/writer, a liquid crystal display, and a double-station thermal and dot matrix printer. In accordance with the present invention, a configuration mounted on an electronic weighting device allows for the weighing of postcards, envelopes, and packages. A magnetic and IC card reader/writer is provided in order to allow for payment by debit, credit, or IC cards in addition to payment by cash or check to an employee. An alphanumerical keyboard is provided in order to allow for the entry of alphanumerical data regarding the item to be mailed, which data is further converted and printed on the item to be mailed in the form of laser readabe bar code. If direct printing is unsuitable, the bar code can be printed on a self-adhesive label to be stuck on the item to be mailed.

20 Claims, 8 Drawing Sheets

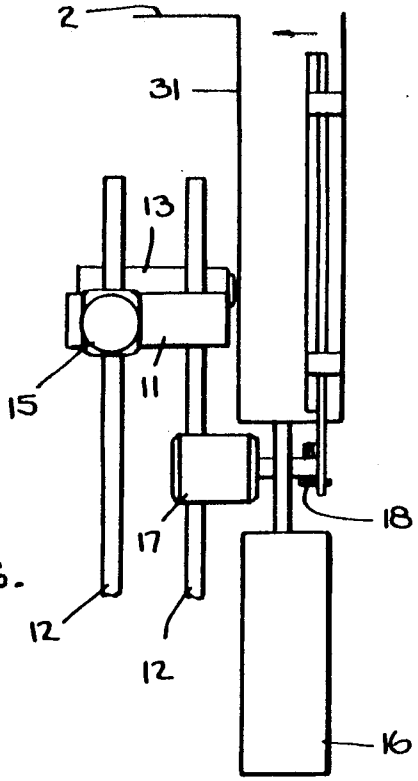
Fig. 6.
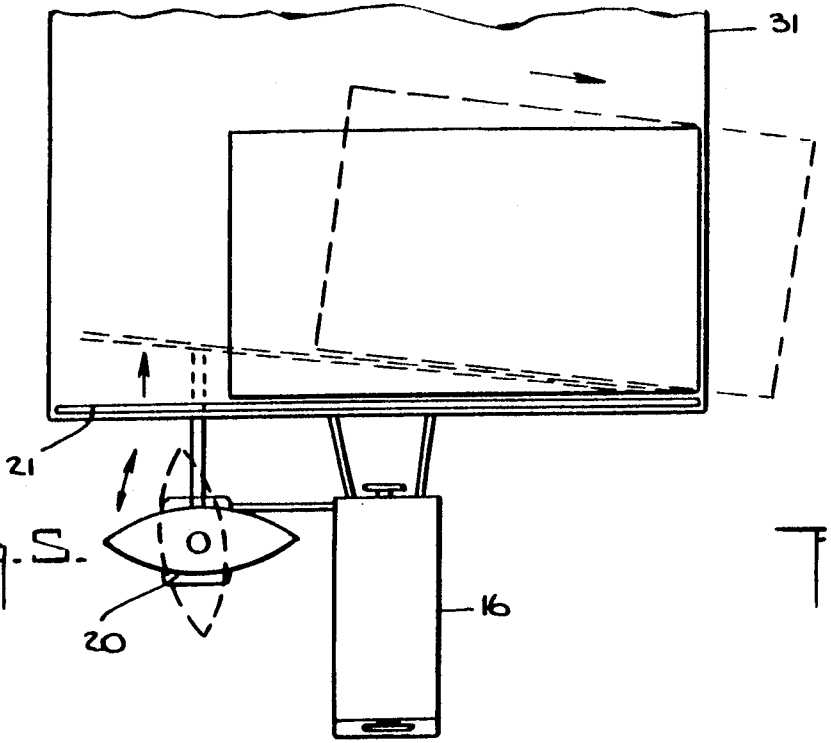
Fig. 5.
Fig. 7.
JULY 14 1988

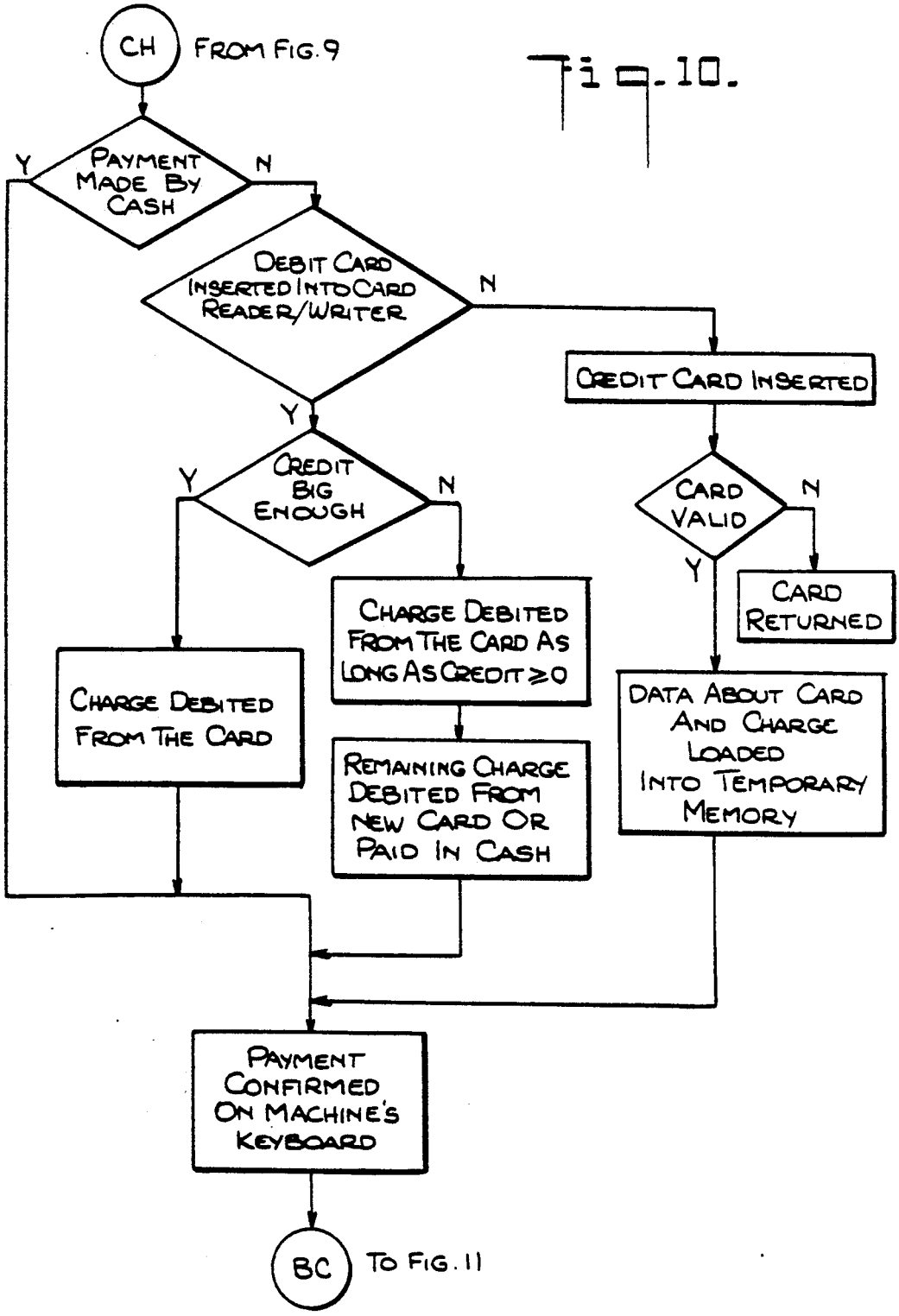
CH
FROM FIG. 9
Fig. 10.
PAYMENT MADE BY CASH
Y
N
DEBIT CARD INSERTED INTO CARD READER/WRITER
N
CREDIT CARD INSERTED
Y
CREDIT BIG ENOUGH
Y
N
CARD VALID
N
Y
CARD RETURNED
CHARGE DEBITED FROM THE CARD AS LONG AS CREDIT ≥ 0
CHARGE DEBITED FROM THE CARD
DATA ABOUT CARD AND CHARGE LOADED INTO TEMPORARY MEMORY
REMAINING CHARGE DEBITED FROM NEW CARD OR PAID IN CASH
PAYMENT CONFIRMED ON MACHINE'S KEYBOARD
BC
TO FIG. 11

AUTOMATED ELECTRONIC POSTAGE METER HAVING A DIRECT ACESS BAR CODE PRINTER

The present invention relates to postage meters and in particular to electronic postage meters having a microprocessor to control the printing of postage and the accounting therefor.

BACKGROUND OF THE INVENTION

Conventional postage meters have the ability to determine the weight of a mailing, calculate the postage charge by an electronic means, and print this charge on the mailing. The payment for such a charge is then either debited from a previously charged memory or paid in cash to an employee who operates the machine in a postal office. It is generally known that these devices are used for the efficient and economical stamping of postcards, letters, and packages but that they can not significantly improve the automation of the further sorting and tracking process because such mailings must go through an additional postage checking procedure. Even in the best of solutions, these mailings can be sorted only by comparatively slow scanning procedures performed by photosensitive means with a comparatively low first read rate.

Generally known devices which have the ability to print horizontally oriented clocked code on a mailing significantly improve the sorting process but demand complicated handling because such a code must be precisely printed relative to an envelope's lower edge so that both the clock and information tracks line up with their appropriate reading head. Consequently, the location of the face of a mailing is particularly important and only single-pass scanning by photosensitive transducers is possible which makes the sorting process comparatively slow and uneconomical.

Hence, it is an object of the present invention to provide a device with the ability to weigh a mailing by electronic means and, based on its destination and other data entered on an alphanumerical keyboard, automatically print any required data in the form of laser readable bar code on the mailing or on a self-adhesive label to be stuck on the mailing for the purpose of enabling a completely automatic sorting and tracking process. When using any of the bar code types which are readable by a multi-pass laser scanning means installed on both sides of a mailing driving conveyor found in sorting hubs, an extremely fast and completely automatic sorting and tracking process with an almost perfect first read rate is achievable.

Considering the fact that some countries have an alphanumeric zip code and that a combination of two letters is the most suitable form of coding, either for a country code or a special request code, an alphanumeric type bar code is preferred for use with the present invention. By printing an alphanumeric bar code on a mailing, the present invention enables faster sorting and tracking of international mail traffic because this code allows one to choose a different two-letter code for each country and for a reasonable number of special requests while occupying very little space on the mailing itself.

Another object of the present invention is to provide a device which is able to accept payment by a variety of means including by cash or check paid to an employee, or by debit cards, various types of credit cards, or IC cards. In accordance with the present invention, all of these payment means can be used, thereby giving the invention a significant advantage, particularly in countries where the postal and telephone systems are owned by the same company and where, therefore, the postage can be debited from a pay-phone debit card or be automatically charged to a customer's telephone bill. When used in corporate mail rooms, in addition to printing a bar code on the outgoing mail, the present invention can be used for printing a bar code on the internal mail so that it too can be economically and automatically sorted.

SUMMARY OF THE INVENTION

An object of the present invention is to provide an electronically controlled postage meter which automatically prints the zip code, country code, special request code, and identification code directly on a postcard, letter, or package, referred to as "the" or "a" "mailing" in this text, in the form of laser readable bar code. The physical configuration of the present invention enables almost all mailings to be weighed and labeled by an automated electronic means but if this is unsuitable, a self-adhesive bar code label can be printed and manually stuck on a mailing.

In order to achieve the above object, the invention provides an electronic scale insertion slot and an electronic scale top surface mounted on an electronic weighing device, a mailing pressing unit also mounted on the weighing device, a thermal transfer printing head which has direct access to the mailing, an alphanumerical keyboard, a mailing dispensing mechanism, a liquid crystal display, and a double-station thermal and dot matrix printer In accordance with the present invention, an inserted mailing is automatically weighed by an electronic means and after its destination is entered on a keyboard, a charge is automatically calculated according to instructions from the machine's memory. The charge is then displayed both to the employee and to the customer and upon a confirmation that the charge has been paid, the mailing pressing, bar code printing, and mailing dispensing procedures occur. According to individual requirements, the bar code printed on a mailing or on a self-adhesive label may comprise data about the mailing's destination zip code, the country of destination, and any special requests with any other identification code which is required for the purpose of tracking a mailing with a particular special request.

Another object of the present invention is to provide a device able to accept different payment means. The invention therefore provides a magnetic and IC card reader/writer for accepting payment by a debit card, various types of credit cards, or IC cards in addition to accepting payment by cash or check through an employee. In order to make the mail accepting procedure as fast as possible, the machine also has the ability to perform a "follow on" procedure if the same customer wants to mail more than one item. The features and advantages of the present invention will become apparent from the following brief description of the drawings and the detailed description of the invention.

BRIEF DESCRIPTION OF THE DRAWINGS

FIG. 5 is the front view of the machine's electronic scale device and the mailing dispensing mechanism mounted thereon;

FIG. 6 is the left side view of the machine's scale configuration and its printing configuration and pressing mechanism wherein the pressing mechanism and scale configuration are mounted on the electronic scale device;

FIG. 7 is an example of the bar code to be printed on a mailing or on a self-adhesive label having a zip code and a country code printed in the first line, an identification code in the second line, and a special request code in the third line;

FIGS. 9 to 11 are flow charts showing the process of the machine as disclosed by the present invention.

DETAILED DESCRIPTION OF THE INVENTION

Figure 1:
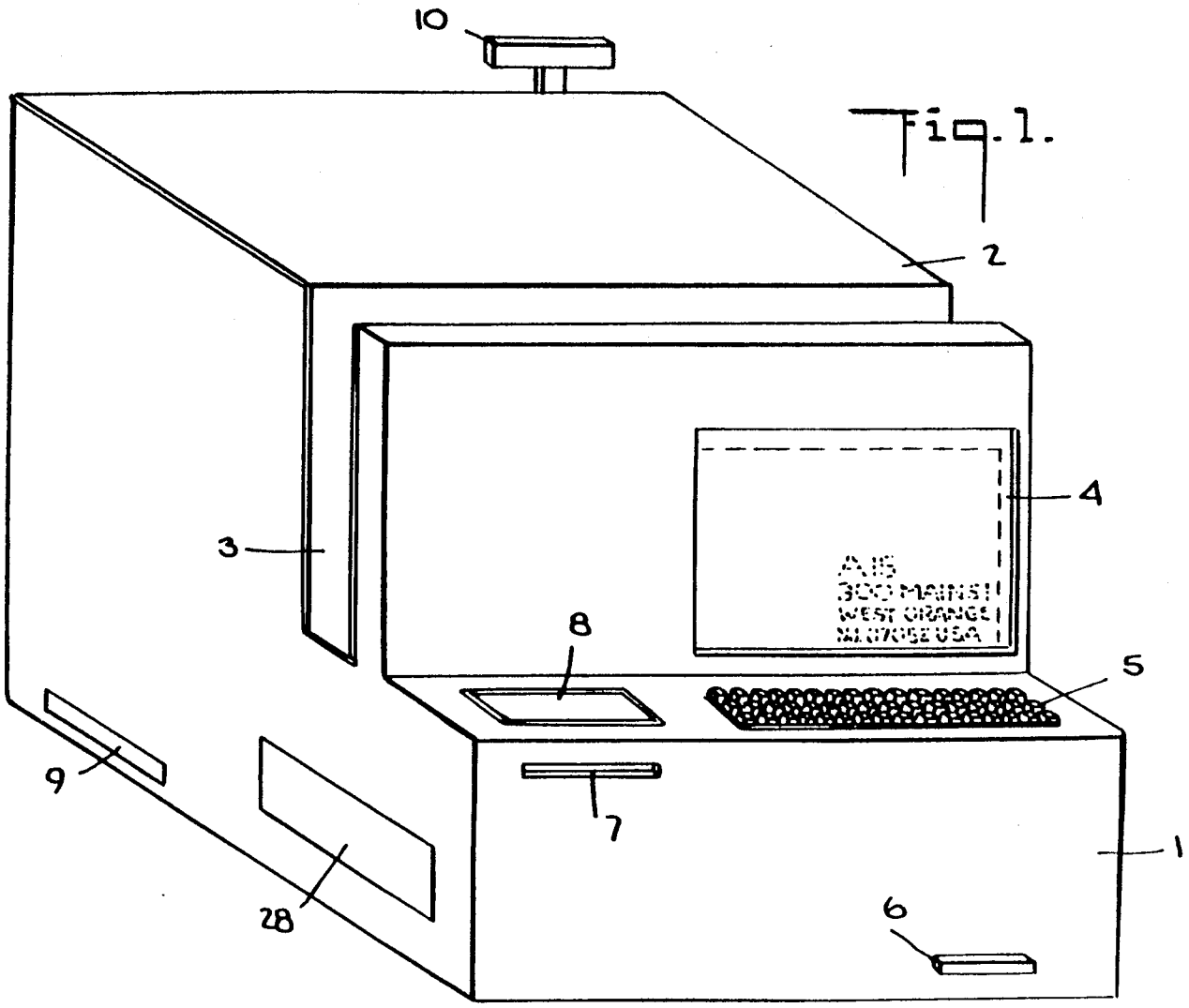
FIG. 1 is a perspective view of the machine housing showing the outside arrangement of its parts as disclosed by an embodiment of this invention.

Referring specifically to the drawings, FIG. 1 illustrates one embodiment of the present invention. With reference to FIG. 1 and in accordance with the invention, the machine housing 1 includes electronic scale top surface 2, electronic scale insertion slot 3, transparent glass window 4, a first alphanumerical keyboard 5, magnetic and IC card reader/writer 6, double-station thermal and dot matrix printer 7 and its paper and ribbon refilling opening 28, a first liquid crystal display 8, disc drive unit 9, a second liquid crystal display 10, and a second alphanumerical keyboard on the back of the machine and in front of the customer, which keyboard is not shown in the drawings.

As shown in FIGS. 2, 3, 4, 5, and 6, the housing 1 also includes a transparent mailing pressing panel 19, with its electromotor 17 and transmission mechanism 18, and a thermal transfer printing head 13 with its four lateral holders 12 on which two printing configuration carriers 11 are mounted for moving the configuration up and down. The carriers 11 are powered by stepping motor 15 also mounted on the configuration Referring now to FIGS. 2 and 4, the configuration further comprises stepping motor 14 for moving the thermal transfer printing head 13 left and right over its supporting bars mounted on carriers 11.

As shown in FIGS. 5 and 6, the housing 1 further comprises an electronic scale device 16 on which insertion slot 3, top surface 2, mailing pressing mechanism 17, 18, and 19, and mailing dispensing bar 21, which is powered by its solenoid 20, are all mounted in order to eliminate any outside influence while an inserted mailing is weighed thereon. The top surface extends horizontally from the top border of the insertion slot's rear wall 31, as shown in FIGS. 1 and 6, and it can be used to weigh mailings unsuitable for being directly printed upon.

Referring again to FIG. 1, the double-station printer 7 comprise two printing heads One printing head is of a dot matrix type used to print customer receipts or for totalling data for an employee upon the entry of specific instructions. The second printing head is of a thermal type used to print data corresponding to the mailing destination in the form of laser readable bar code, as shown in FIG. 7, on a thermal sensitive self-adhesive label. The disc drive unit 9 built into the machine housing 1 is used for storing data about the machine's status for later use in case the machine is installed as an independent unit. When the machine is connected to some external database, all corresponding data can be automatically transferred to such a database for further use. Magnetic and IC card reader/writer 6 built into the housing 1 is able to read and rewrite data on a debit card magnetic stripe and to read data from credit and IC cards for the purpose of accepting payment.

As shown in FIG. 7, the bar code to be printed directly on a mailing by the thermal transfer printing head 13 or on a thermal sensitive self-adhesive label by the thermal head in the double-station printer 7 comprises previously entered and converted data about the mailing destination and, if required, any special request data and, consequently, an identification number. The bar code shown in FIG. 7 is an example of what should be printed on a mailing sent to zip code 75116 in France when an identification number is required and the postage is to be paid by a consignee (PC). The data shown in FIG. 7 can be arranged in a form most suitable for scanning and later tracking purposes.

Figure 8:
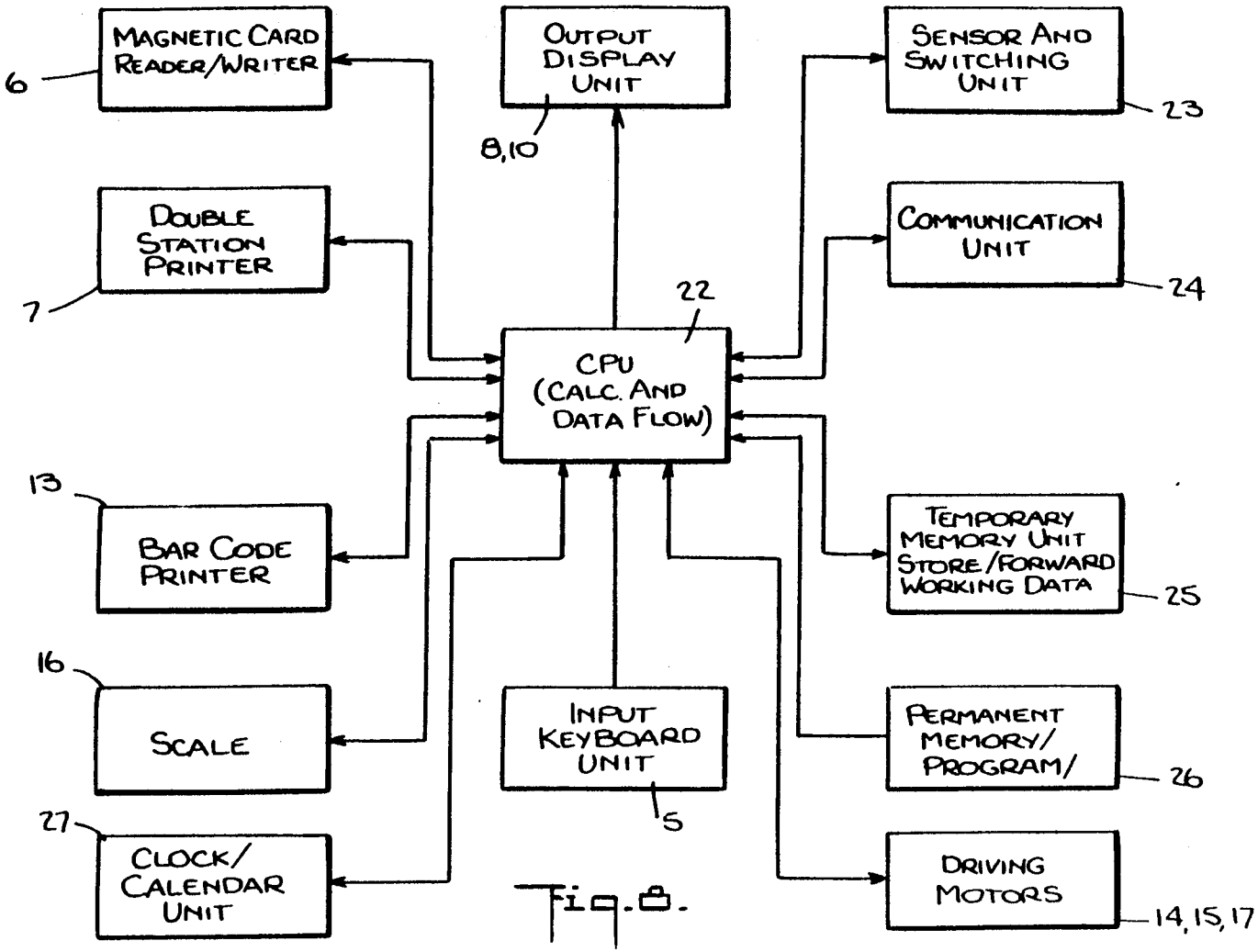
FIG. 8 is a block diagram of the machine in accordance with the present invention.

The machine disclosed herein further includes a control box, not shown in the drawings but schematized in FIG. 8, comprising a central processing unit (CPU) 22, a sensor and switching unit 23, a communication unit 24, a temporary memory unit 25, a permanent memory unit 26, and a clock/calendar unit 27.

The machine disclosed by the present invention can be used in a postal or a courier company's offices or in corporate mail rooms for the same purpose while utilizing a slightly different payment procedure. First, the procedure applied by a postal office or a courier company will be described.

Figure 3:
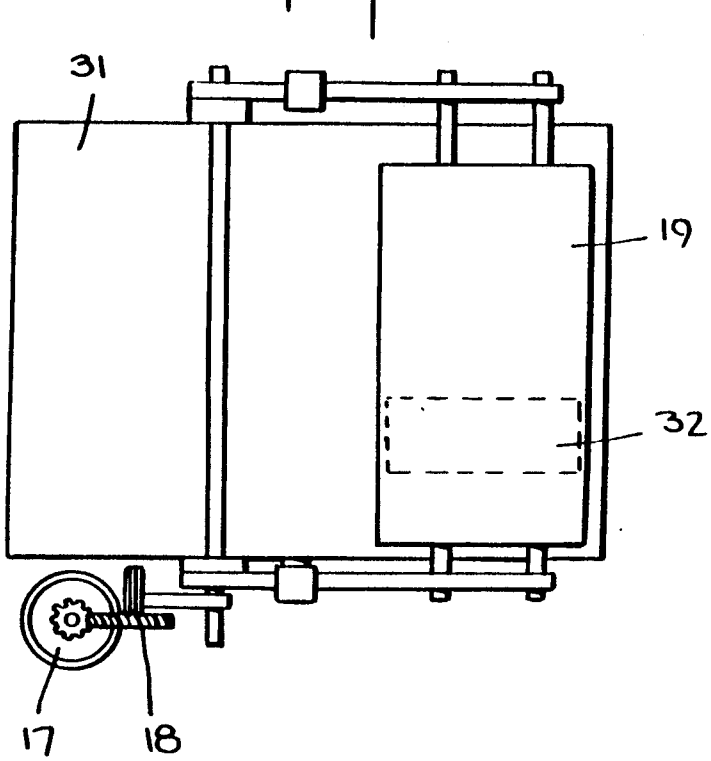
FIG. 3 is the front view of the machine's mailing pressing mechanism.
Figure 4:
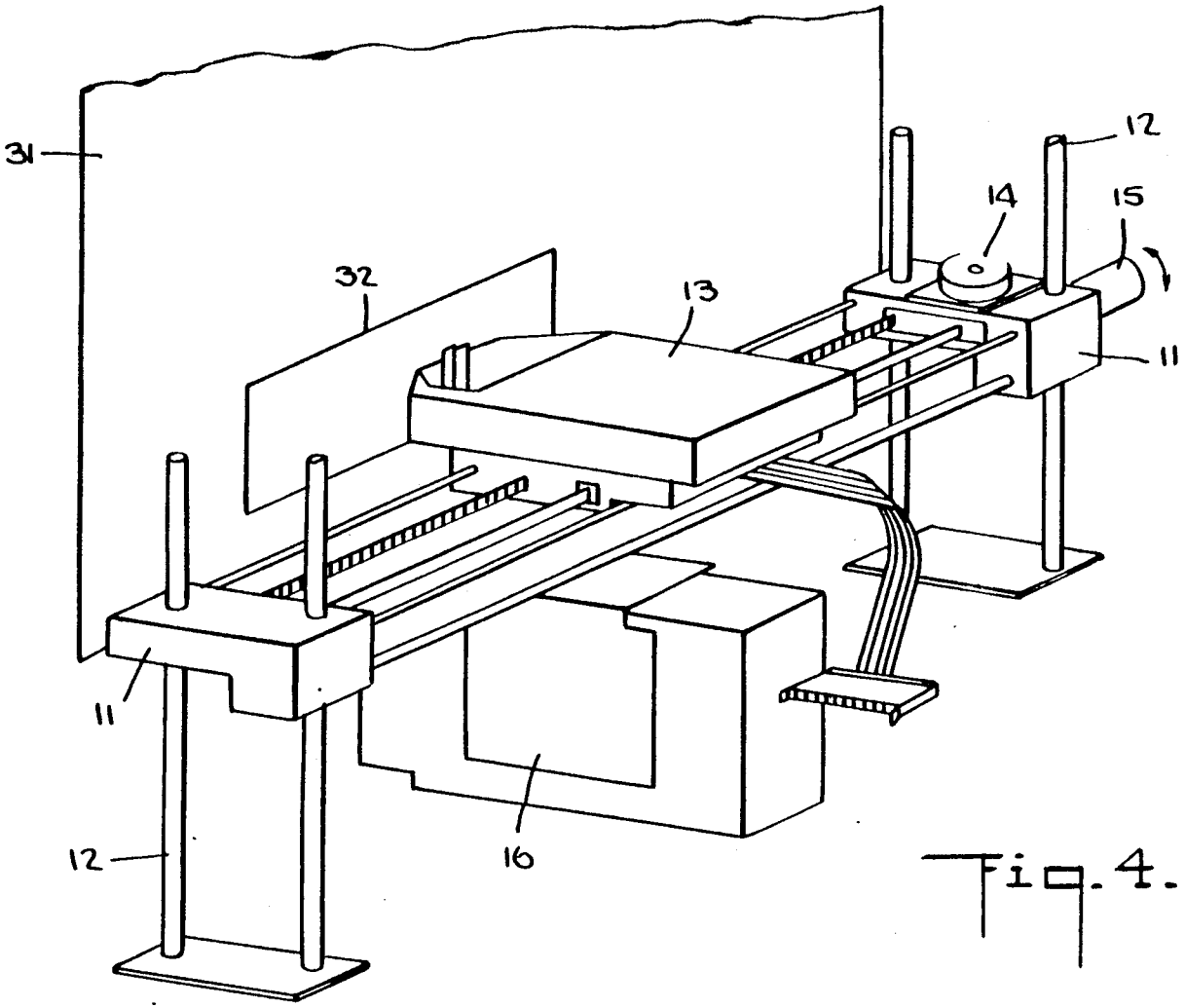
FIG. 4 is a perspective view from the back side of the machine showing the thermal transfer printer configuration located behind the insertion slot's rear wall and also showing the machine's electronic scale device.
Figure 9:
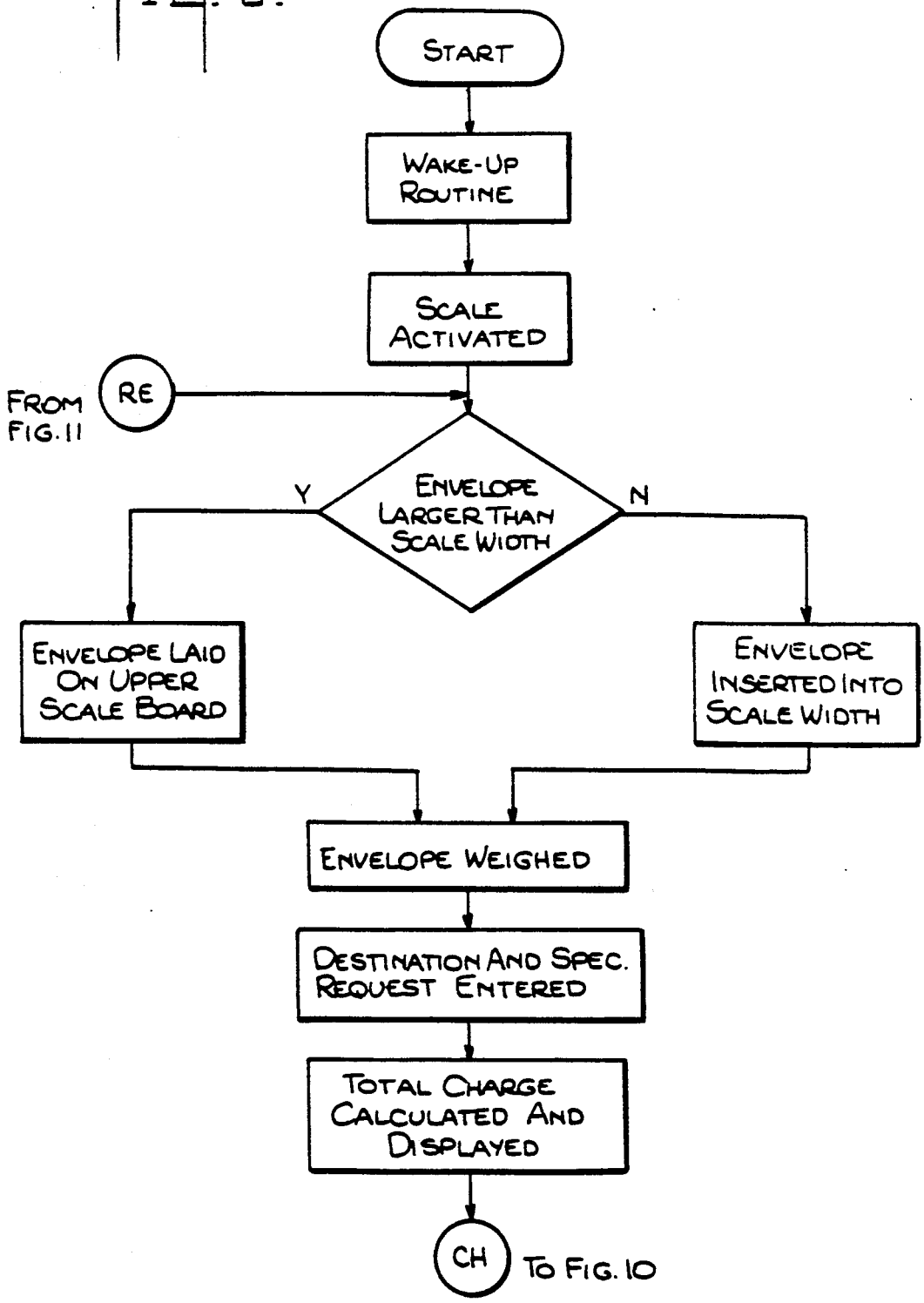

The machine is to be operated by an employee who takes the mailing from a customer and, if the mailing is thinner than 1 inch, inserts it into scale insertion slot 3 or, if the mailing is thicker than 1 inch, unsuitable for pressing, or made of material unsuitable for being printed upon, lays it down on the scale top surface 2. Referring now to FIG. 9, the electronic scale device 16 weighs the mailing and the weight data is loaded into the temporary memory unit 25. If the mailing is inserted into insertion slot 3, its right edge has to be even with the insertion slot's right border so that the address written on the mailing can be read through the transparent glass window 4 as shown in FIG. 1. The right rear side of the mailing would then be located in front of the printing window 32 as shown in FIGS. 3 and 4.

The employee then reads the address on the mailing and manually enters the data regarding the mailing's zip code, country of destination, and any special requests on the machine's alphanumerical keyboard 5. Referring again to FIG. 9, the total postage charge is calculated based on the weight of the mailing, its destination, any special request data entered on the keyboard, and on any data stored in the machine's memory. The charge is then displayed, both on LCD 8 for the employee and on LCD 10 for the customer. Even if the mailing has to be weighed on top surface 2, the data entry, charge calculation, and display procedure is the same as the one described above.

As shown in FIG. 10, the calculated charge can be paid either in cash or check to the employee or by one of the following means:

- a previously bought debit card, wherein the company identification data and any credit amount are encoded on the card's magnetic stripe and debited upon each purchase.
- a valid customer credit card without a personal identification number (PIN);
- a valid customer credit card with a PIN;
- a valid customer IC card.

In countries where the postal system and telephone system operate as one, the debit card can be the same one which is used in the existing pay-phone system.

As shown in FIG. 10, if the payment is made by cash or check, the employee collects the charged amount and confirms the payment on keyboard 5 thereby enabling the machine to continue its process. If the payment is made by a debit card, the employee inserts the card into the machine's magnetic and IC card reader/-writer 6 where the data about the card's validity and credit standing is read and then displayed on both LCDs 8 and 10. The calculated charge is then debited and a new balance is rewritten on the card's magnetic stripe for later use. If the existing credit is not sufficient to cover the postage charge, the card can be debited to zero and the remaining amount paid by a new debit card or in cash. After the charge is debited from the card and if a "follow on" instruction is not entered by the employee, a new balance is displayed and the card is returned. If the card proves to be invalid, a warning is displayed and the invalid card is automatically returned.

If payment is made by a credit card without a PIN, the card is inserted into the reader/writer 6 where its validity is checked and, if proven valid, the card number and the corresponding charge are loaded into the machine's memory to be stored or transferred to some external database for the purpose of later billing. If the card proves to be invalid, a warning is displayed and the card is automatically returned.

If payment is made by a credit card with a PIN or an IC card, the card is inserted into the reader/writer 6 and the customer gets two chances to enter the correct PIN on the small alphanumerical keyboard, not shown on the drawings, located in front of him and not seen by the employee. If the card proves to be valid and the correct PIN is entered, the machine's further procedure corresponds to the one described above.

Once payment is confirmed by the employee on keyboard 5 or by the card reader/writer 6, the machine's further procedure is performed according to the instructions entered by the employee on keyboard 5 and in accordance with one of the possible weighing scenarios.

Figure 2:
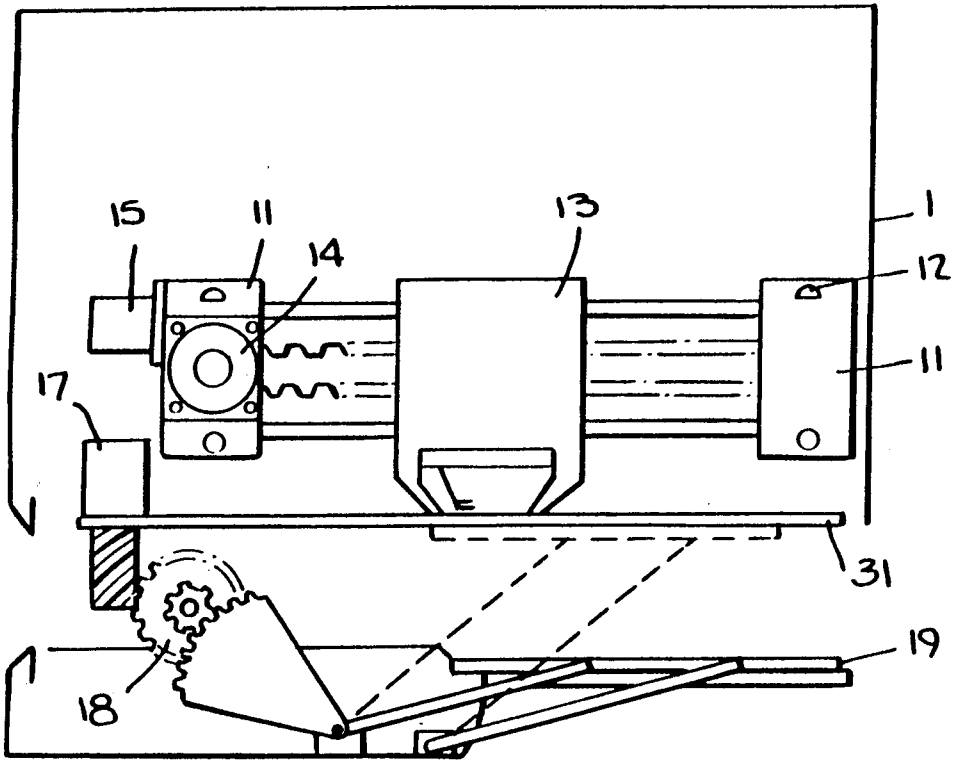
FIG. 2 is the top view of the machine's thermal transfer printer configuration and the mailing pressing mechanism.
Figure 11:
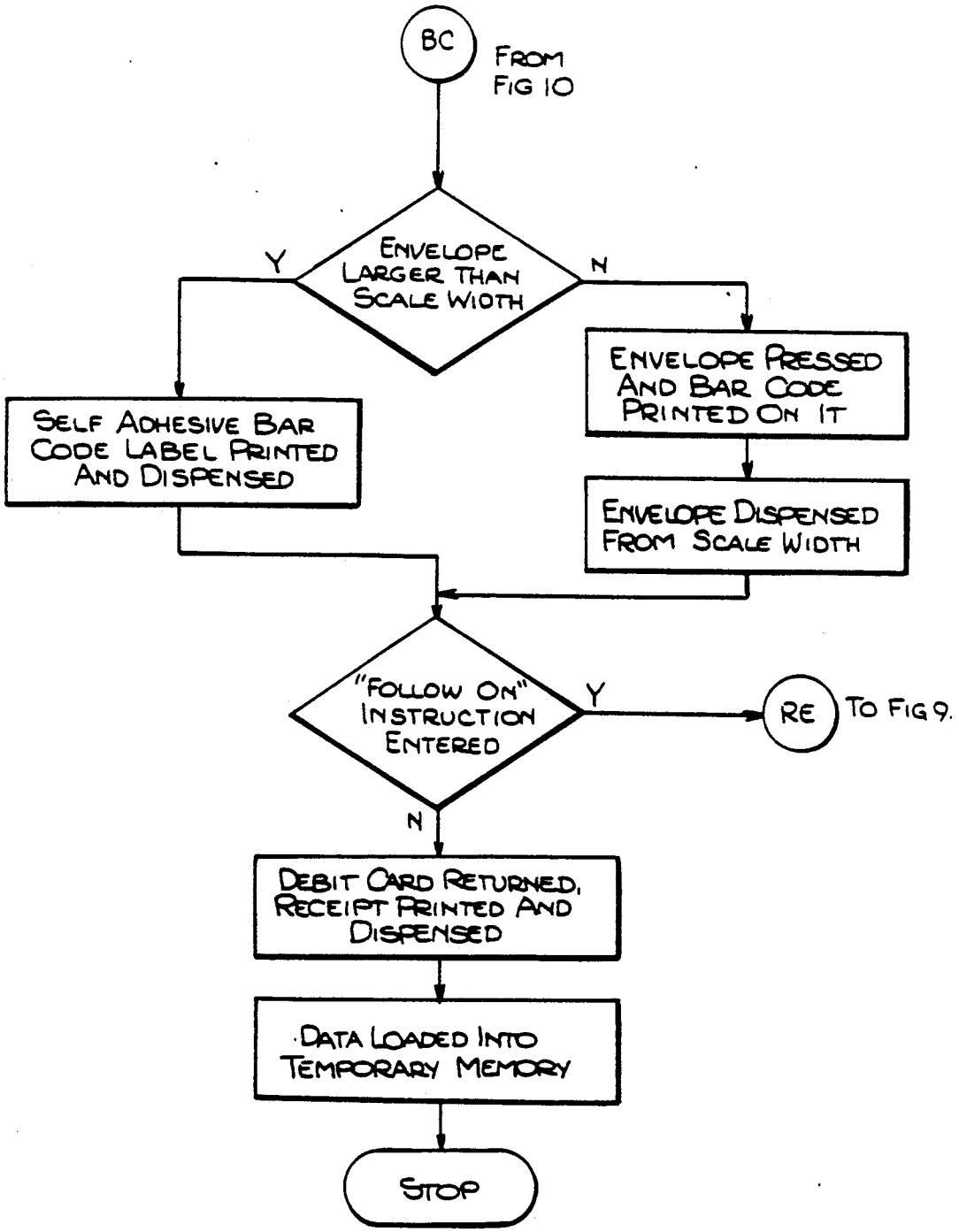

As shown in FIG. 11, a mailing weighed inside scale insertion slot 3 is pressed to the slot's rear wall 31, firmly enough to allow for the accurate printing of the bar code, by the transparent pressing panel 19 which is moved forward by its electromotor 17 over its special transmission mechanism 18 which is shown in FIGS. 2, 3, and 6. The transmission mechanism 18 moves the pressing panel 19 toward the slot's rear wall 31 with a certain predetermined pressure and keeps the panel 19 stationary for as long as is required for the bar code printing process to take place. According to the process of the present invention, mailings of all sizes and up to 1 inch in thickness can be pressed with the pressure required to print the bar code in a satisfactory manner.

Simultaneously with the mailing pressing procedure, the previously entered destination and special requirement data is converted to a form of bar code, as shown in FIG. 7, and after the mailing is pressed and thereby secured, the thermal transfer printing head 13 is activated. The printing head 13 is located behind the slot's rear wall 31 and moves along the length and height of the printing window as shown in FIG. 4. The printing head 13 prints the bar code while moving from left to right, as observed from its position on the back of the machine, and it is powered by stepping motor 14. After the head 13 reaches the right printing margin, the entire configuration 11, 13, and 14 moves one step downwards over the four lateral holders 12 which are powered by stepping motor 15 and prints the next line by moving from right to left. This continues until the entire bar code is printed after which the printing head 13 returns to its starting position.

When using an alphanumeric type bar code, as shown in FIG. 7, any type of zip code, country code, and special requirement code can be printed, either in a high density horizontal position or, as preferred, in one bar code line under another while having the corresponding human readable characters printed under each line with the date of acceptance and postage paid printed in human readable characters in the bottom line. For mailings without a special request only one bar code line is necessary to include the data on the zip code and the country of destination.

It is to be understood that any other data can be added or some of the shown data eliminated depending on individual requirements and standards. It is also to be understood that any type of bar code and any type of combination can be applied even though alphanumeric Code-39 as shown appears to be the most suitable. Despite the reasonable assumption that the best results in terms of bar code quality and corresponding costs can be obtained by using a thermal transfer printing head, it is to be understood that another printing means could be used for this purpose.

According to the process of the present invention and as shown in FIG. 11, as soon as the printing head 13 returns to its starting position, the pressing panel 19 turns backward to its starting position and the mailing is released. As shown in FIG. 5, solenoid 20 turns and lifts the left side of the mailing dispensing bar 21, thereby allowing the mailing to slide out of insertion slot 3.

Referring again to FIG. 11, after the mailing is weighed on scale top surface 2 and upon confirmation of payment and based on instructions from the keyboard, the thermal printing head inside the double-station printer 7 prints the bar code on a thermal sensitive self-adhesive label and dispenses it to the employee so that it can be manually stuck on the mailing. The self-adhesive label includes the same data, printed according to the same principle as that previously described for direct on the mailing printing. During this type of printing procedure, the pressing panel 19, the thermal transfer printing head 13, and the dispensing bar 21 remain inactive. Furthermore, if any kind of special requirement, such as a request for express or registered mail, is entered on the keyboard, the dot matrix printing head found in double-station printer 7 prints and dispenses a receipt for the customer.

The present invention can also be used in corporate mail rooms, either for outgoing or internal mail, where the destination data and special request data are printed in the form of a bar code by an identical procedure to the one described above but one including slightly different payment method. In this case, the payment has to be made either by a debit card issued by the corporate owner, which is permanently used until the encoded credit expires, or by a credit card where the data about the card and any corresponding charge is stored or forwarded for the purpose of later billing. If payment is made by an IC card, which is yet another possibility, the charge can be accumulated in the machine's memory and, at the end of a working day, forwarded to be automatically debited from a customer's bank account. Company employees could also use the machine for sending their own outgoing mail by paying the charge with a debit, credit, or IC card. The machine could also be used for printing a bar code on internal company mail to enable the sorting of such mail through a "hub and spoke" system wherein a predetermined internal bar code could be identified by the system and where such a code would be printed free of charge.

It will be understood that the present invention has been described in relation to a particular embodiment, herein chosen for the purpose of illustration, and that the claims are intended to cover all changes and modifications, apparent to those skilled in the art, which do not constitute a departure from the scope and spirit of the invention.

What is claimed is:

1. An apparatus for use by an employee in processing an item to be mailed comprising:

a computer;

an electronic scale having a first weighting surface and a second weighting surface, the scale being coupled to the computer for weighing the item to be mailed;

a first alphanumeric keyboard coupled to the computer for entering data relating to the item to be-mailed, including the address to which said item is to be mailed;

determining means coupled to the computer means, to the scale, and to the first alphanumeric keyboard for determining the required postage for said item to be mailed;

an electronic display screen coupled to the computer and to the determining means, the display screen displaying the required postage for said item to be mailed;

an external payment accepting means for accepting payment from an external source, the external payment accepting means being coupled to the computer;

an external payment verifying means for verifying payment from an external source for the postage due, the external payment verifying means being coupled to the computer; and a printer coupled to the computer for providing machine readable information concerning the item to be mailed including the zip code to which said item is to be mailed, on the item to be mailed, after receipt of payment from an external source is verified.

2. The apparatus according to claim 1, including:

means coupled to said computer for detecting the presence of debit, credit, or IC cards, for reading said cards, for validating said cards, for charging said cards, and for returning said cards.

3. The apparatus according to claim 1, wherein the printer includes:

means coupled to said computer and to said alphanumeric keyboard for converting said data directly into laser readable alphanumeric bar code which includes both letters and numbers;

a first print head for printing said laser readable bar code directly on the item to be mailed; and a second print head for printing said laser readable bar code on an adhesive label t be stuck on the item to be mailed.

4. The apparatus according to claim 1, wherein the printer further comprises a third print head coupled to said computer for printing and dispensing a receipt detailing the transaction performed by said apparatus.

5. The apparatus according to claim 1, further comprising a second electronic display screen for displaying the required postage for the item to be mailed.

6. The apparatus according to claim 3, further comprising a pressing mechanism for pressing the item to be mailed against a surface proximate the first print head to allow the printer to print thereon.

7. The apparatus according to claim 1, further comprising ejecting means for ejecting the item to be mailed from the postage meter after the printer has printed information thereon.

8. Apparatus for processing an item to be mailed comprising:

an electronic scale a housing, the housing including an electronic scale top surface mounted on the electronic scale for weighing an item to be mailed, an electronic scale insertion slot mounted on the electronic scale for weighing an item to be mailed, and data entry means for entering data relating to the item to be mailed including address;

a computer coupled to the electronic scale and to the data entry means, the computer including determining means for determining the required postage for the item to be mailed;

means coupled to the computer and to the data entry means for converting data entered by the data entry means directly into a laser readable bar code;

an electronic display coupled to the computer for displaying the required postage for said item to be mailed;

means for receiving payment and sending a signal that payment has been received, the means for receiving payment including at least one of an electronic external payment accepting means for accepting external payment and means for verifying that payment has been made externally the apparatus;

two printers for printing the laser readable bar code, the two printers including a first printer for printing said code directly on items to be mailed and a second printer for printing said code on a separate label for items to be mailed, the printers being coupled to the computer;

wherein the computer controls the printers such that the printers will not operate until the signal indicating that payment has been received is received.

9. The apparatus of claim 8, wherein the housing further comprising a transparent window located proximate the electronic scale insertion slot such that an item to be mailed located in the insertion slot is visible from the exterior of the housing.

10. The apparatus of claim 8, further comprising a third printer for printing a receipt detailing the transaction performed by the apparatus.

11. The apparatus of claim 8, wherein the apparatus includes an electronic payment accepting means capable of accepting at least one of a debit card and an IC card.

12. The apparatus of claim 8, further comprising a pressing mechanism for pressing the item to be mailed against a surface proximate the printer to allow the printer to print on the item to be mailed.

13. The apparatus of claim 8, further comprising a mail ejecting means located in the electronic scale insertion slot for ejecting an item to be mailed after it has been printed upon by the printer.

14. The apparatus of claim 8, further comprising:

a transparent window located in the housing adjacent the electronic scale insertion slot such that when an item to be mailed is located in the electronic scale insertion slot, the item is visible through the transparent window;

a pressing mechanism located in the electronic scale insertion slot for pressing an item to be mailed against a surface proximate the firs printer to enable the printer to print on the item to be mailed; and the third printer coupled to the computer for printing and dispensing a receipt detailing the transaction performed by the apparatus.

15. The apparatus of claim 14, further comprising a disk drive coupled to the computer for storing information regarding the status of the machine.

16. The apparatus of claim 8, further comprising a disk drive coupled to the computer for storing data regarding the status of the machine.

17. A postage meter for use in a postal office to facilitate processing of a transaction between a customer and a postal office employee and subsequent mailing of an item to be mailed, the postage meter comprising:

a housing, the housing comprising a front side, a back side, a top surface and a bottom surface a computer located within the housing;

an electronic scale coupled to the computer, the electronic scale comprising two distinct weight in surfaces, the electronic scale being adapted to weigh the item to be mailed when the item to be mailed is placed on either of the two weighing surface and transmitting a signal indicative of the weight of the item to be mailed to the computer;

an alphanumeric keyboard for allowing the employee to enter information pertaining to the destination of the item to be mailed into the computer including address;

a first electronic display coupled to the computer, the first electronic display being visable from the front side of the postage meter;

a second electronic display coupled to the computer, the second electronic display being visable from the back side of the postage meter;

the computer comprising a CPU for calculating the postage due based upon the signals from the electronic scale and information from the alphanumeric keyboard, and displaying the postage due on both the first electronic display and the second electronic display;

means for generating a signal verifying the customer's payment for postage due and sending the signal to the computer;

a printer for printing an alphanumeric laser readable bar code indicative of the destination and the method of mailing of the item to be mailed directly on the item to be mailed;

a double station printer comprising a first printing head for printing an alphanumeric laser readable bar code including both letters and numbers, indicative of the destination and method of mailing of the item to be mailed on a separate label and a second printing head for printing a record of the transaction, the printer being operable only after the computer receives the signal verifying external payment for postage due.

18. The postage meter of claim 17, wherein at least one of the electronic displays is a liquid crystal diode display.

19. The postage meter of claim 17, further comprising a second keyboard, the second keyboard being located on the back side of the housing for use by the customer.

20. The postage meter of claim 17, further comprising an electronic operating external payment accepting means comprising at least one of a debit card or an IC card.

* * * * *